US011511144B2

(12) United States Patent
Koiwa

(10) Patent No.: US 11,511,144 B2
(45) Date of Patent: Nov. 29, 2022

(54) SPRINKLER HEAD

(71) Applicant: SENJU SPRINKLER CO., LTD., Tokyo (JP)

(72) Inventor: Yasuaki Koiwa, Tokyo (JP)

(73) Assignee: SENJU SPRINKLER CO., LTD., Tokyo (JP)

( * ) Notice: Subject to any disclaimer, the term of this patent is extended or adjusted under 35 U.S.C. 154(b) by 9 days.

(21) Appl. No.: 17/256,747

(22) PCT Filed: Apr. 22, 2019

(86) PCT No.: PCT/JP2019/016949
§ 371 (c)(1),
(2) Date: Dec. 29, 2020

(87) PCT Pub. No.: WO2020/008707
PCT Pub. Date: Jan. 9, 2020

(65) Prior Publication Data

US 2021/0260423 A1 Aug. 26, 2021

(30) Foreign Application Priority Data

Jul. 5, 2018 (JP) ..... JP2018-128127

(51) Int. Cl.
*A62C 31/02* (2006.01)
*B05B 1/26* (2006.01)

(52) U.S. Cl.
CPC ..... *A62C 31/02* (2013.01); *B05B 1/265* (2013.01)

(58) Field of Classification Search
CPC ..... A62C 31/02; B05B 1/265
(Continued)

(56) References Cited

U.S. PATENT DOCUMENTS 3,010,521 A * 11/1961 Seaberg ..... A62C 37/10 169/40
3,061,016 A * 10/1962 Hodgman, Jr. ..... A62C 37/12 169/42

(Continued)

FOREIGN PATENT DOCUMENTS

EP 0505672 B1 11/1996
JP 15-006137 Y1 5/1940

(Continued)

OTHER PUBLICATIONS

International Search Report for PCT Patent App. No. PCT/JP2019/016949 (dated Jun. 18, 2019).

*Primary Examiner* — Chee-Chong Lee
(74) *Attorney, Agent, or Firm* — Cermak Nakajima & McGowan LLP; Tomoko Nakajima

(57) ABSTRACT

A sprinkler head includes a main body having, thereinside, a nozzle connected to a water supply pipe, a deflector having a disk shape with a plurality of slits in an edge portion, where the deflector is disposed so as to intersect with a central axis of the nozzle, and a support member configured to connect the main body to the deflector. A circular arc shaped first convex portion is formed in a direction from the center of the deflector to a position obtained by rotating the position of the support member by 90 degrees around the center, circular arc shaped first slits are disposed on either side of the convex portion, and the shape of a portion from one of the first slits to the other via the first convex portion is corrugated.

14 Claims, 5 Drawing Sheets

(58) Field of Classification Search
USPC ..... 169/37
See application file for complete search history.

(56) References Cited

U.S. PATENT DOCUMENTS

| | | | | |
|---|---|---|---|---|
| 4,616,710 | A | 10/1986 | Pilant et al. | |
| 6,840,329 | B2 * | 1/2005 | Kikuchi | A62C 37/09 169/56 |
| 6,962,208 | B2 * | 11/2005 | Franson | A62C 37/09 169/41 |
| 7,275,603 | B2 * | 10/2007 | Polan | A62C 37/09 169/41 |
| 2004/0134670 | A1 * | 7/2004 | Orr | A62C 35/68 169/37 |
| 2013/0014963 | A1 * | 1/2013 | Porta | A62C 31/02 285/305 |

FOREIGN PATENT DOCUMENTS

| | | | |
|---|---|---|---|
| JP | 10-24121 | A | 1/1998 |
| JP | 2012-080961 | A | 4/2012 |
| JP | 2013-056084 | A | 3/2013 |

* cited by examiner

SPRINKLER HEAD

This application is a national phase entry under 35 U.S.C. § 371 of PCT Patent Application No. PCT/JP2019/016949, filed on Apr. 22, 2019, which claims priority under 35 U.S.C. § 119 to Japanese Patent Application No. 2018-128127, filed May 7, 2018, both of which are incorporated by reference.

TECHNICAL FIELD

The present invention relates to a sprinkler head for firefighting.

BACKGROUND ART

A sprinkler head is installed on a ceiling or a wall. In the event of a fire, the sprinkle is activated to spray water to extinguish the fire. An example of a sprinkler head is one in which a deflector protrudes from the ceiling to the inside of the room when activated and sprays water.

The sprinkler head described above has a deflector suspended by a plurality of posts, which is normally housed in a cylindrical frame. In the event of a fire, a disassembled unit of the deflector is disassembled, and the deflector supported by the disassembled unit falls by a certain distance and, thereafter, stops falling. The water ejected from the sprinkler head hits the deflector so as to be sprayed in all directions.

In the United States, the National Fire Protection Association standards for sprinkler head installation and construction have been established as NFPA 13 to set down the design and installation of sprinkler systems based on the end-use application of a building. As the standards for residential sprinkler systems, NFPA 13D and 13R were provided. In addition, as the standard for residential sprinkler heads, UL 1626 was provided by Underwriters Laboratories (UL LLC).

The sprinkler head described in PTL 1 is one of the above-mentioned residential sprinkler heads, in which the pins for suspending the deflector are disposed outside of the main body of the sprinkler head. As illustrated in FIG. 7, the outer shape of the deflector 5 has a substantial circular shape. In contrast, a convex portion H1 at which a pin 5C is disposed has an outwardly extending shape.

A plurality of slits 5A are formed at the edge of the deflector 5, and the spray pattern is controlled by the shape of the slits 5A (for example, the lengths, widths, and angles). In general, in the directions of the slits 5A, the amount of water sprayed on the floor tends to be greater in an area directly below the sprinkler head and in the short distance area, while in the directions of the convex portions each formed between the two slits 5A and 5A, the amount of water sprayed on the floor tends to be greater in the long distance area away from the sprinkler head.

Residential sprinkler heads are required by UL 1626 to spray water on wall surfaces in addition to spraying water on the floor. One of the requirements for spraying water on walls is that the wall surface must be wetted less than a predetermined distance from the ceiling surface to the floor.

Accordingly, the shapes of the slits and convex portions are designed such that a certain amount of water is directed to the wall surface as well as the floor. However, since there is no obstacle to water sprinkling, such as a pin, in a direction from the center of the deflector to a position obtained by rotating the position of the pin around the center by 90 degrees, water tends to be sprayed too far.

In addition, the activation of a sprinkler head installed around a sprinkler head that is spraying water may be delayed if the heat-sensitive disassembly unit is cooled by the sprayed water. For this reason, the water must be dispersed downwardly below the horizontal to avoid wetting the sprinkler heads installed around. In addition, the above-mentioned wall wetting conditions must be satisfied.

CITATION LIST

Patent Literature

PTL 1: Japanese Unexamined Patent Application Publication No. 2012-80961

SUMMARY OF INVENTION

Technical Problem

In view of the above problem, the present invention provides a sprinkler head capable of moderately wetting a wall surface and obtaining a spray pattern that does not affect the operation performed by a surrounding sprinkler head.

Solution to Problem

To achieve the above objective, the present invention provides the following sprinkler head. That is, a sprinkler head includes a main body having, thereinside, a nozzle connected to a water supply pipe, a deflector having a disk shape with a plurality of slits in an edge portion, where the deflector is disposed so as to intersect with a central axis of the nozzle, and a support member configured to connect the main body to the deflector. A circular arc shaped first convex portion is formed in a direction from the center of the deflector to a position obtained by rotating the position of the support member by 90 degrees around the center, circular arc shaped first slits are disposed on either side of the convex portion, and the shape of a portion from one of the first slits to the other via the first convex portion is corrugated.

In the above sprinkler head, the water that is discharged from the nozzle and that collides with the deflector and flows onto the first convex portion is dispersed from the edge of the first convex portion in a radial direction in the form of atomized water. In contrast, the water flow dispersed from the first slit becomes a gathered water flow, which moves the surrounding air. Thus, an air flow is generated. The atomized water dispersed from the first convex portion reaches a distant area of the floor surface and a wall away from the sprinkler head under the influence of the airflow.

The first convex portion and a second convex portion adjacent to the first slit are disposed inside the outer diameter of the deflector, so that the water flow discharged from the nozzle passes through the first slit with its momentum intact. Thereafter, the water flow is evenly sprayed to the point immediately below the sprinkler head and the short-distance surrounding area. As a result, the required amount of sprayed water can be provided onto the short distance area and the long distance area of a floor and a wall surface.

Advantageous Effects of Invention

As described above, according to the present invention, water dispersed from the first convex portion becomes atomized, and the atomized water can be made to reach a wall surface or a far away point by the airflow generated by the gathered water flow in the first slit. As a result, a sprinkler head can be achieved that prevents the surrounding sprinkler heads from being covered with water and does not affect the operation thereof.

DESCRIPTION OF EMBODIMENTS

The present invention is described with reference to FIGS. 1 to 6. A sprinkler head S according to the present invention includes a main body 1, a valve body 2, a heat-sensitive disassembly unit 3, a deflector 4, and the like.

Figure 1:
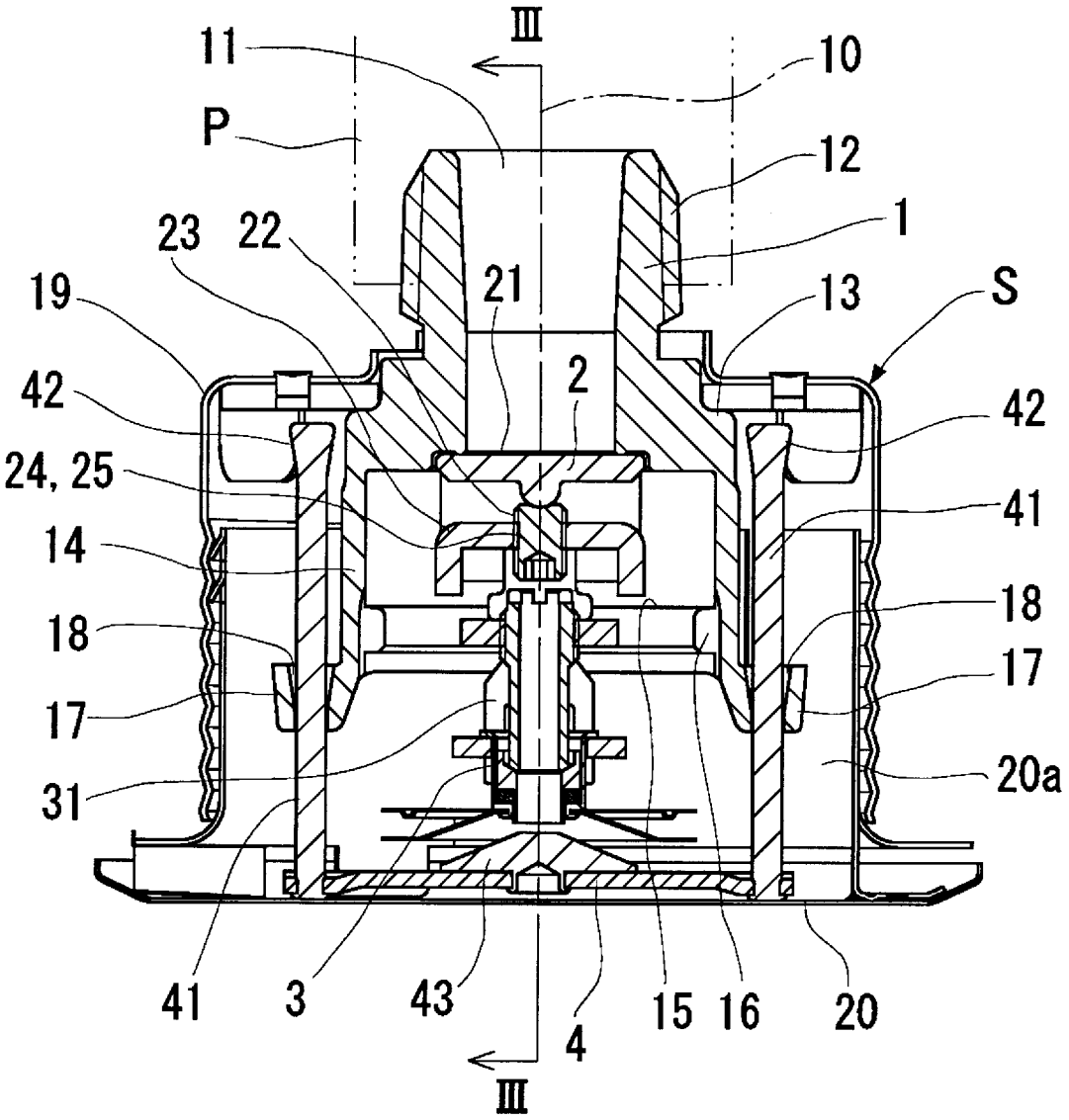
FIG. 1 is a cross-sectional view of a sprinkler head according to the present invention.
Figure 2:
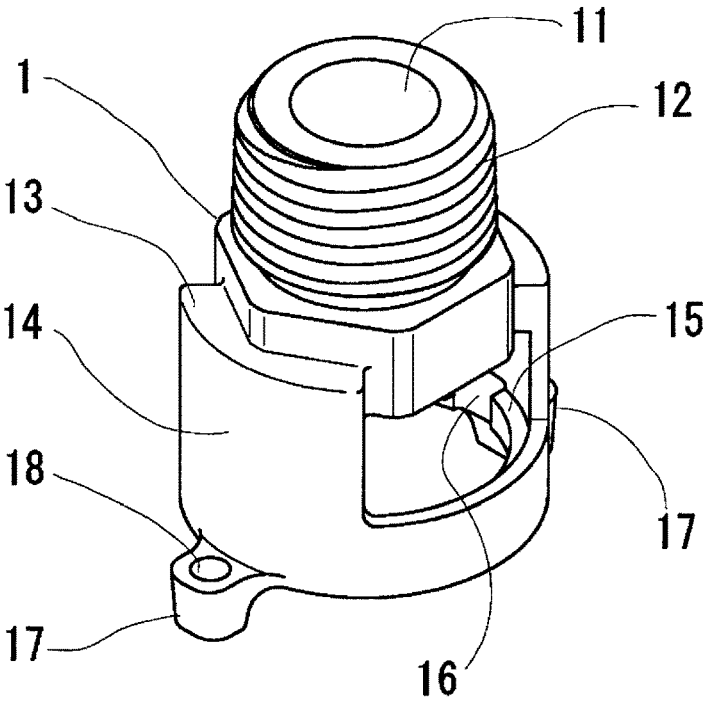
FIG. 2 is a perspective view of a main body.

As illustrated in FIGS. 1 to 2, the main body 1 has a hollow shape and has a nozzle 11 thereinside. The main body 1 has a male screw 12 connectable to a water supply pipe P at one end thereof and has a valve body 2 disposed at the other end thereof. The nozzle 11 is closed at all times.

The main body 1 has, in the middle portion thereof, a flat surface 13 extending outwardly. A cylindrical peripheral wall portion 14 is formed from the outer periphery of the flat surface 13 in the water discharge direction of the nozzle 11. The peripheral wall portion 14 has a stepped portion 15 disposed in the inner lower end portion thereof, and the stepped portion 15 has levers 31 and 31 of the heat-sensitive disassembly unit 3 engaged therewith. The stepped portion 15 has missing portions 16 and 16, which are formed facing each other. The levers 31 and 31 are passable through the missing portions 16 and 16 to enter inside of the peripheral wall portion 14.

Two protrusions 17 are formed on the outer periphery of the peripheral wall portion 14 to suspend the deflector 4. The protrusions 17 are formed away from the missing portion 16. In the drawing, the protrusions 17 are located at positions obtained by rotating the positions of the missing portions 16 by 90 degrees. Each of the protrusions 17 has a hole 18 drilled parallel to a central axis 10 of the nozzle 11. The hole 18 is a tapered hole, and the diameter of the hole at the end adjacent to the nozzle 11 is larger than that at the other end.

A support cup 19 having a cylindrical shape is disposed on the periphery of the peripheral wall portion 14, and the main body 1 is disposed inside the support cup 19. The upper end surface of the support cup 19 serves as an engagement surface with the flat surface 13, and the support cup 19 is attached to the main body 1. A cover plate 20 is disposed below the support cup 19, and the deflector 4 is placed on the cover plate 20, as illustrated in FIG. 1.

The cover plate 20 is joined to the lower end of a cylindrical retainer **20*a* by using a low-melting-point alloy. If the low-melting-point alloy is melted by the heat of a fire, the cover plate 20 separates from the retainer 20*a* and falls off. The upper portion of the retainer 20*a* is inserted inside the support cup 19. The side surface of the support cup 19 and the side surface of the retainer 20*a* have a connecting structure that allows the retainer 20*a* to be engaged with the support cup 19**.

The valve body 2 has a disk shape and closes the outlet end of the nozzle 11, as described above. A sealing member 21 is provided on the surface of the valve body 2 adjacent to nozzle 11. According to the present embodiment, a fluoroplastic sheet serving as the sealing member 21 is bonded to the valve body 2. The valve body 2 has a hemispherical protrusion at the center of the surface opposite to the surface having the sealing member 21 disposed thereon. The protrusion is in contact with an end of a compression screw 22, and the valve body 2 is urged in the direction of the nozzle 11 by the compression screw 22.

The compression screw 22 and a saddle 23 are disposed between the valve body 2 and the heat-sensitive disassembly unit 3. The compression screw 22 has a male screw 24 engraved on the outer circumference and is screwed to a female screw 25 formed on the saddle 23. The saddle 23 is made of metal and has a rectangular flat surface. The female screw 25 is disposed at the center of the flat surface. In the drawing, the lower surfaces of both ends of the flat surface of the saddle 23 are in contact with the levers 31 and 31 of the heat-sensitive disassembly unit 3. This provides a structure in which the valve body 2 is in contact with the outlet end of the nozzle 11 by the levers 31 and 31, which are engaged with the stepped portion 15, the saddle 23, and the compression screw 22. In this configuration, when the compression screw 22 is rotated and, thus, the top end of the compression screw 22 is moved in the direction toward the valve body 2, the valve body 2 is urged against the outlet end of the nozzle 11.

At this time, even if the compression screw 22 is rotated, the movement of the saddle 23 toward the nozzle 11 is prevented by the valve body 2. Accordingly, the saddle 23 moves downward in the drawing. However, since both ends of the saddle 23 are engaged with the levers 31 and 31 and, thus, the movement of the saddle 23 downward is prevented, the flat surface of the saddle 23 is bent into an arch and is elastically deformed, so that the substantial middle portion having the female screw 25 disposed therein is curved downward. As a result, a force caused by the elasticity of the saddle 23 is also exerted on the levers 31 and 31 which are in contact with both ends of the saddle 23.

Figure 3:
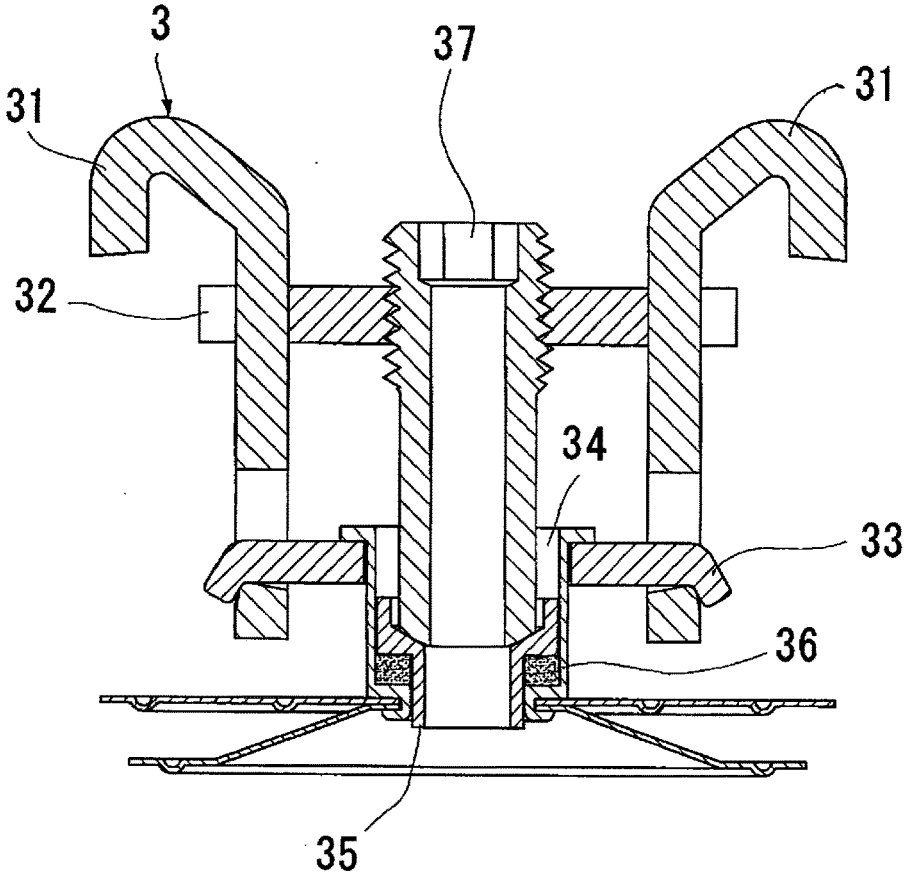
FIG. 3 is a cross-sectional view of a heat-sensitive disassembly unit taken along line III-III of FIG. 1.

The heat-sensitive disassembly unit 3 is engaged with the above-described stepped portion 15 and supports the valve body 2 in normal times. In the case of a fire, the heat-sensitive disassembly unit 3 is disassembled due to the heat of fire and operates to release the valve body 2. As illustrated in FIG. 3, the heat-sensitive disassembly unit 3 includes the pair of levers 31, a support plate 32, a balancer 33, a cylinder 34, a plunger 35, a low-melting-point alloy 36, and a set screw 37. Since the configuration of the heat-sensitive disassembly unit 3 is well known, detailed description is not provided.

The heat-sensitive disassembly unit 3 is configured as a unit part illustrated in FIG. 3 and can be stored and transported as a unit part. In addition, when the sprinkler head S is assembled, the heat-sensitive disassembly unit 3 is assembled into the main body 1 as a unit part illustrated in FIG. 3.

The deflector 4 has a disk shape and intersects perpendicularly with the central axis 10 of the nozzle 11. In FIG. 1, the deflector 4 is slidably mounted to the main body 1 by two pins 41 and 41. More specifically, each of the pins 41 and 41 is slidably inserted into one of the holes 18 of the main body 1, and the lower end of the pin 41 is disposed and fixed to the deflector 4. The upper end of the pin 41 serves as an engagement portion 42 with the hole 18 and increases in diameter toward the upper end. The above-described pins 41 and the holes 18 in the body function as a support member that connects the main body 1 to the deflector 4.

Figure 4:
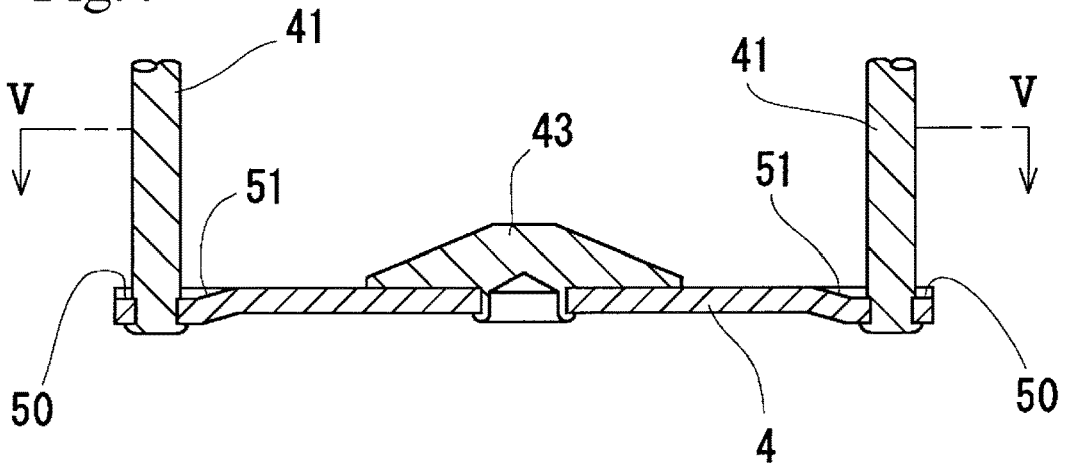
FIG. 4 is an enlarged cross-sectional view of the main portion of a deflector.
Figure 5:
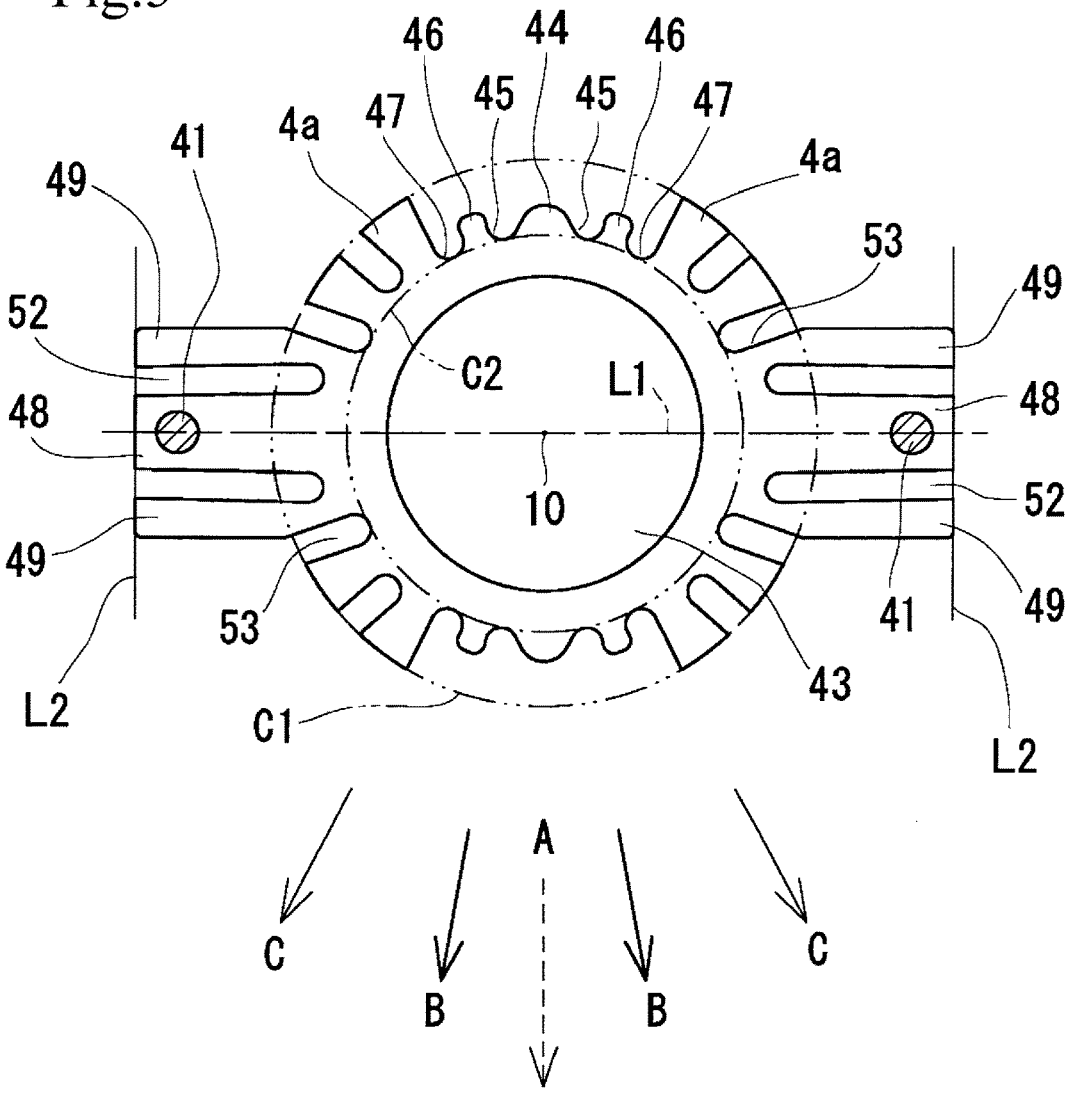
FIG. 5 is a cross-sectional view taken along line V-V of FIG. 4.

In FIGS. 4 and 5, the deflector 4 has a button 43 at the center thereof. The button 43 protrudes in the direction of the nozzle 11. The deflector 4 is provided with the two pins 41 and 41 disposed on a straight line L1 extending along the flat surface of the deflector 4 and intersecting with the central axis 10 of the nozzle 11. The deflector 4 has a plurality of slits that are linearly cut out from the edge to the center thereof. The end of each of the slits adjacent to the center of the deflector 4 is formed as a circular-arc end. In addition, a portion between a slit and the neighboring slit is a convex portion. Note that the shapes of the slits and the convex portions of the deflector 4 illustrated in FIG. 5 are symmetrical to each other with respect to the straight line L1.

In FIG. 5, an arc-shaped first convex portion 44 is disposed in the direction from the center of the deflector 4 (the intersection point of the central axis 10 of the nozzle 11 and the straight line L1) to the position obtained by rotating the position of each of the pins 41 and 41 around the center by 90 degrees. Arc-shaped first slits 45 and 45 are disposed on either side of the first convex portion 44. More specifically, the outer shape of the deflector 4 from one of the first slits 45 to the other via the first convex portion 44 is corrugated. In addition, the first convex portion 44 and second convex portions 46 each adjacent to the first slit 45 are disposed inside an outer circumference circle C1 of the deflector 4.

In the above configuration, the first convex portion 44 and the second convex portions 46 are formed shorter than the nearby convex portions, and the shape from one of the first slit 45 to the other is corrugated. Water discharged from the nozzle 11 collides with the button 43 and flows towards the outer periphery of the deflector 4, and part of the water flowing in the direction from the corrugated first convex portion 44 to the second convex portion 46 passes through the first slit 55 and is evenly distributed to the point immediately below the sprinkler head S and its short-distance surrounding area. At this time, a gathered water flow is generated in the direction of each of the first slits 45 and 45 (in the direction of arrow B).

Figure 6:
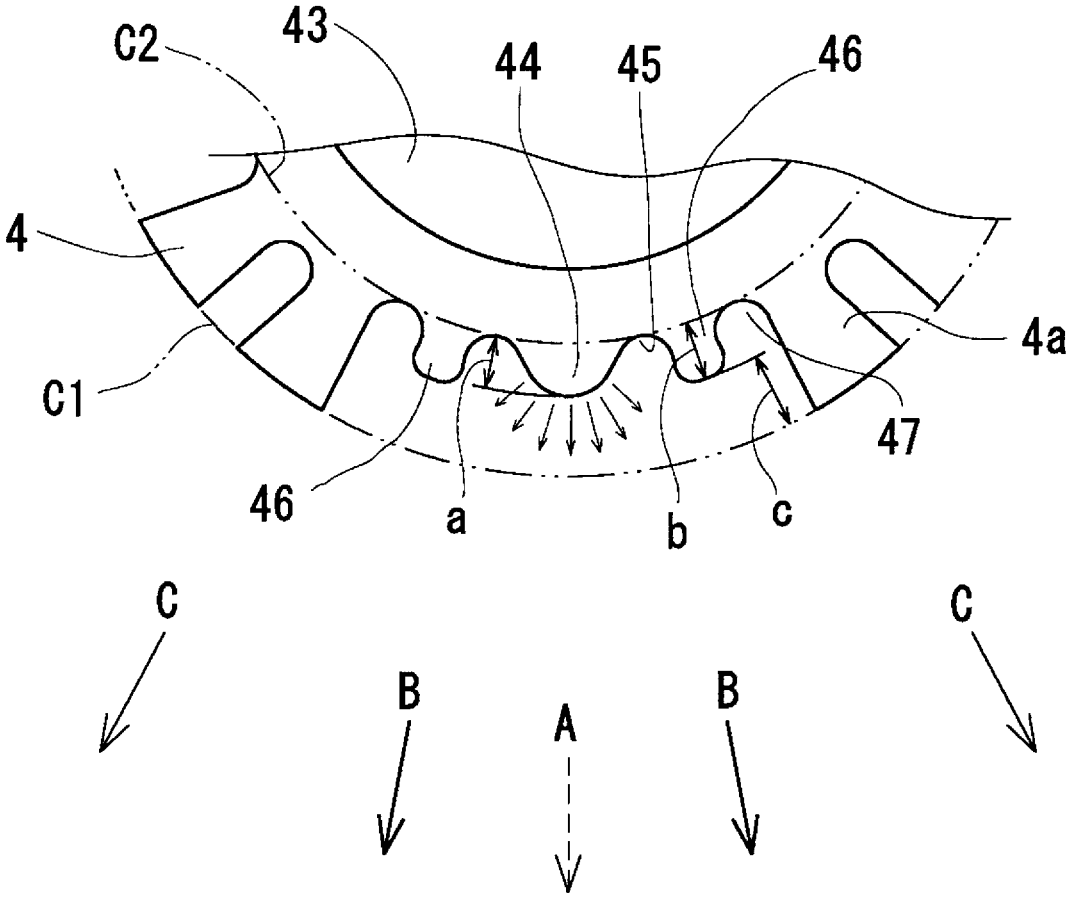
FIG. 6 is an enlarged view of a main portion illustrated in FIG. 5.
Figure 7:
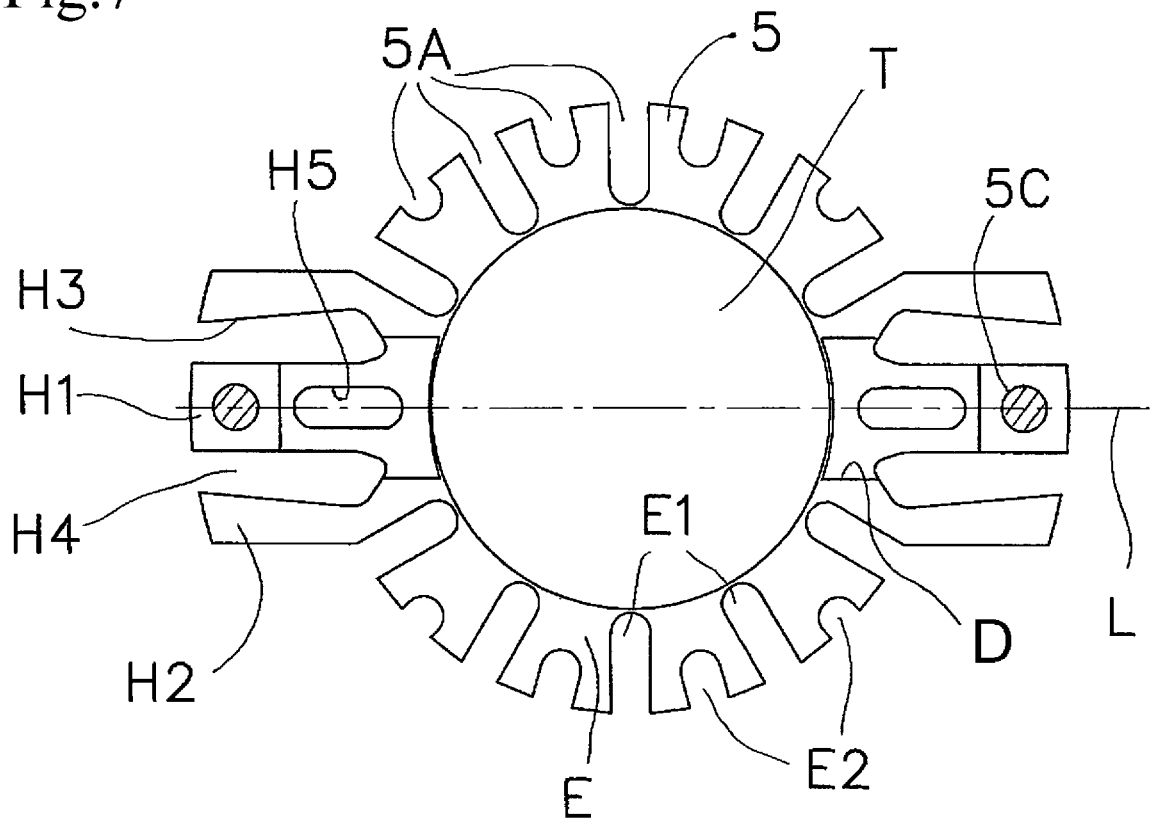
Fig.7 Prior Art
FIG. 7 is a plan view of an existing deflector.

In contrast, the water flow dispersed from the first convex portion 44 is dispersed in the radial direction from the edge of the first convex portion 44, as indicated by the arrows illustrated around the first convex portion 44 in FIG. 6. For this reason, the water flow in the direction of arrow A becomes an atomized water flow. However, since the gathered water flow is generated in the direction of each of the first slits 45 and 45, an airflow is generated by this water flow. The generated airflow carries the atomized water flow dispersed in the direction of Arrow A to a distance and wets a wall surface that is located on an extension of the direction A. The shape of the top end of the second convex portion 46 and the shape of the corner between the second convex portion 46 and each of neighboring first slit 45 and second slit 47 are rounded (circular arcs), and the water dispersed from the circular arc area is dispersed in the radial direction, like the water dispersed from the edge of the first convex portion 44.

As illustrated in FIG. 6, it is desirable that the distance a between the top end of the first convex portion 44 and the circular arc edge of the first slit be 1 to 2 mm. If the distance a is too large, the water flow in the direction of arrow B tends to increase, while the water flow in the direction of arrow A tends to decrease.

The length b of the second convex portion 46 is shorter than the length of the neighboring convex portion 4*a*. A dimension c, which is the length obtained by subtracting the length b of the second convex portion 46 from the length of the convex portion 4*a*, is set to be substantially the same as or slightly greater than the length of the second convex portion 46. By adjusting the length b of the second convex portion 46, the water flow from the center of the deflector 4 toward the second convex portion 46 (in the direction of arrow C) can be controlled. More specifically, if the length b of the second convex portion 46 is reduced, the water flow dispersed in the direction of arrow C tends to be attracted toward the water flow indicated by arrow B, and the amount of water sprayed in the direction of arrow C is reduced.

Third convex portions 48 are disposed on the straight line L1. Each of the third convex portions 48 has the pin 41 disposed thereon. The pin 41 is disposed outside the outer circumference circle C1 of the deflector 4. In addition, the top end of the third convex portion 48 extends outside the outer circumference circle C1 of the deflector 4. Fourth convex portions 49 are disposed along the straight line L1 on either side of the third convex portion 48, and the top end of the fourth convex portion 49 and the top end of the third convex portion 48 are on a straight line L2 that intersects perpendicularly with the straight line L1.

The top end of the third convex portion 48 is bent in a direction farther away from the nozzle 11 than the flat surface of the fourth convex portion 49 and, thus, a step 50 is formed. A hole is drilled in the step 50 so as to enable the lower end of the pins 41 to be inserted thereinto. After the pin 41 is inserted into the hole, the pin 41 is fixed to the step 50. The third convex portion 48 has a slope face 51 thereon in the vicinity of the step 50, and the slope face 51 is located outside the outer circumference circle C1 of the deflector 4.

A third slit 52 is formed between the third convex portion 48 and the fourth convex portion 49 so as to be slightly inclined with respect to the straight line L1. For this reason, the width of the third convex portion 48 decreases towards the top end.

The circular-arc ends of a fourth slit 53 adjacent to the fourth convex portion 49, the first slit 45, and the second slit 47 are in contact with a circle C2 which is concentric with the outer circumference circle C1 of the deflector 4. The circle C2 has a smaller diameter than the outer circumference circle C1 of the deflector 4.

In terms of the flying distance of water in the direction of the straight line L1 in which the pins 41 are disposed, the pins 41 obstruct the flow of water. Therefore, the top ends of the third convex portion 48 and the fourth convex portion 49 are located outside the outer circumference circle C1 of the deflector 4 to increase the takeoff distance of the water flowing from the button 43 in the direction of the pin 43.

The water that reaches the third slit 52 passes through the third slit and flows downward. In contrast, the water that flows on the surface of the third convex portion 48 maintains the momentum of the water flow until it reaches the slope face 51. Consequently, a flow rate that is sufficient to wet the wall surface on the extension in the L1 direction can be provided.

The configuration of the sprinkler head S according to the present invention is not limited to the above-described configuration. For example, a glass valve or a link can be used as the heat-sensitive disassembly unit 3. In addition, the support member that connects the main body to the deflector can be configured as a frame arm extending from the main body in the water discharge direction of the nozzle, and the deflector according to the present invention may be mounted on the top end of the frame arm.

REFERENCE SIGNS LIST

1 main body
2 valve body
3 heat-sensitive disassembly unit
4 deflector
11 nozzle
41 pin
43 button
44 first convex portion
45 first slit
46 second convex portion
47 second slit
48 third convex portion
49 fourth convex portion
50 step

The invention claimed is:

1. A sprinkler head comprising:

a main body having a nozzle thereinside, the nozzle being connected to a water supply pipe;

a deflector disposed so as to intersect with a central axis of the nozzle; and a pair of pins configured to connect the main body to the deflector by inserted slidably into each of holes of the main body, wherein the deflector is formed in a disk shape and has convex portions, first convex portions, second convex portions, and first slits, wherein top ends of the convex portions form an outer circumference circle of the deflector, first slits are located on both sides of the first convex portions, the second convex portions are located adjacent to the first slits respectively, the first convex portions and the second convex portions are formed shorter than the convex portions, and located inside the outer circumference circle of the deflector, the pair of pins are disposed on third convex portions which is located the outside of the outer circumference circle of the deflector, wherein each of the first convex portions is formed as a convex circular-arc shaped edge located at a position obtained by rotating the position of the pair of pins by 90 degrees around the center of the deflector, wherein each of the second convex portions is formed as a convex circular-arc shaped edge, different shape from that of the first convex portions, wherein each of the first slits is formed as concave circular-arc shaped edges, one of the first convex portions, one of the first slits and one of the second convex portions, are continuously arranged in this order.

2. The sprinkler head according to claim 1, wherein the deflector has a second slits formed as a concave circular-arc shaped edge adjacent to the second convex portion and opposite from the one of the first slits, and wherein the concave circular-arc shaped edge of the first slits and the concave circular-arc shaped edge of the second slits are in contact with a smaller circle concentric with a smaller diameter than the outer circumference circle of the deflector.

3. The sprinkler head according to claim 2, wherein the the pair of pins are disposed on a first straight line that intersects with the central axis of the nozzle and that extends along a flat surface of the deflector, and wherein the pair of pins are disposed on the third convex portions.

4. The sprinkler head according to claim 3, wherein the deflector further has fourth convex portions on either side of the third convex portion, and the top end of each of the fourth convex portions and the top end of the third convex portion are located on a second straight line that intersects perpendicularly with the first straight line.

5. The sprinkler head according to claim 4, wherein the top end of the third convex portion includes a step that is bent in a direction farther away from the nozzle than a flat surface of the fourth convex portion.

6. The sprinkler head according to claim 5, wherein the step is formed as a slope face, and wherein the slope face is located outside the outer circumference circle of the deflector.

7. The sprinkler head according to claim 4, wherein the deflector further has a third slit between the third convex portion and the fourth convex portion, wherein the third slit is inclined with respect to the first straight line, and wherein the width of the third convex portion decreases towards the top end.

8. The sprinkler head according to claim 4, wherein the deflector further has a fourth slit adjacent to the fourth convex portion, and wherein the circular-arc shaped edge of the fourth slit is in contact with the circumference of the circle together with the circular-arc shaped edge of the first slits and the circular-arc shaped edge of the second slits.

9. The sprinkler head according to claim 4, wherein a distance between the circular-arc shaped edge of one of the first slits and the circular-arc shaped edge of the other first slits is greater than a distance between the circular-arc shaped edge of the first slits and the circular-arc shaped edge of the second slits neighboring the first slits.

10. The sprinkler head according to claim 2, wherein a dimension obtained by subtracting a length of the second convex portion from a radius difference between the outer circumference circle of the deflector and the smaller circle with which the circular-arc shaped edge of the second slits is in contact is the same as the length of the second convex portion.

11. The sprinkler head according to claim 2, wherein a dimension obtained by subtracting a length of the second convex portion from a radius difference between the outer circumference circle of the deflector and the smaller circle with which the circular-arc shaped edge of the second slits is in contact is greater than the length of the second convex portions.

12. The sprinkler head according to claim 1, wherein the width of the first convex portion increases from the top end thereof towards the center of the deflector.

13. The sprinkler head according to claim 1, wherein the width of the second convex portion increases from the top end thereof towards the center of the deflector.

14. The sprinkler head according to claim 1, wherein a distance between the circular-arc shaped edge of the first convex portion and the circular-arc shaped edge of the first slits is 1 to 2 mm.

* * * * *